United States Patent [19]

Crimaldi

[11] 4,406,231

[45] Sep. 27, 1983

[54] MOTION PRODUCING MECHANISM

[76] Inventor: Daniel Crimaldi, 2002 Reservoir Rd., Reading, Pa. 19604

[21] Appl. No.: 265,702

[22] Filed: May 21, 1981

Related U.S. Application Data

[63] Continuation-in-part of Ser. No. 66,238, Aug. 13, 1979, Pat. No. 4,269,122.

[51] Int. Cl.[3] ..... B61B 10/04; A63H 11/00

[52] U.S. Cl. ..... 104/172 BT; 104/56; 104/167; 105/29 R; 46/122

[58] Field of Search ..... 105/29 R, 29 TL; 104/56, 57, 166, 167, 172 BT; 198/648, 728; 46/122

[56] References Cited

U.S. PATENT DOCUMENTS

| | | | |
|---|---|---|---|
| 2,264,549 | 12/1941 | Pecker | 193/108 |
| 3,163,054 | 12/1964 | Werner | 74/422 |
| 3,190,140 | 6/1965 | Werner | 74/501 |
| 4,086,855 | 5/1978 | Newbegin | 104/172 BT |
| 4,237,648 | 12/1980 | Moe et al. | 46/122 |

*Primary Examiner*—Richard A. Bertsch

*Attorney, Agent, or Firm*—Antonelli, Terry & Wands

[57] ABSTRACT

In systems for moving items such as novelties along a predetermined path, it is desirable that the system be lightweight and inexpensive, while being capable of forward and backward movement along the path. To accomplish this, an apparatus is provided for moving the item having a hollow holding means, such as a tube, with a slot which extends along the predetermined path. A helically threaded means is provided inside the holding means with a predetermined spacing between each of the threads. Driving means mesh with the space between the threads to move the helically threaded means relative to the hollow holding means. Mounting means, such as pins, are provided on the helically threaded means to extend through the opening in the holding means for connection of an item to the helically threaded means. As an alternative to the helically threaded means, a cable having alternating large and small diameter regions can be provided. Also, as an alternative for the hollow tube, a channel-shaped spring holder can be provided having substantially flat upper surfaces for supporting a carrier upon which the item to be moved can be mounted.

22 Claims, 10 Drawing Figures

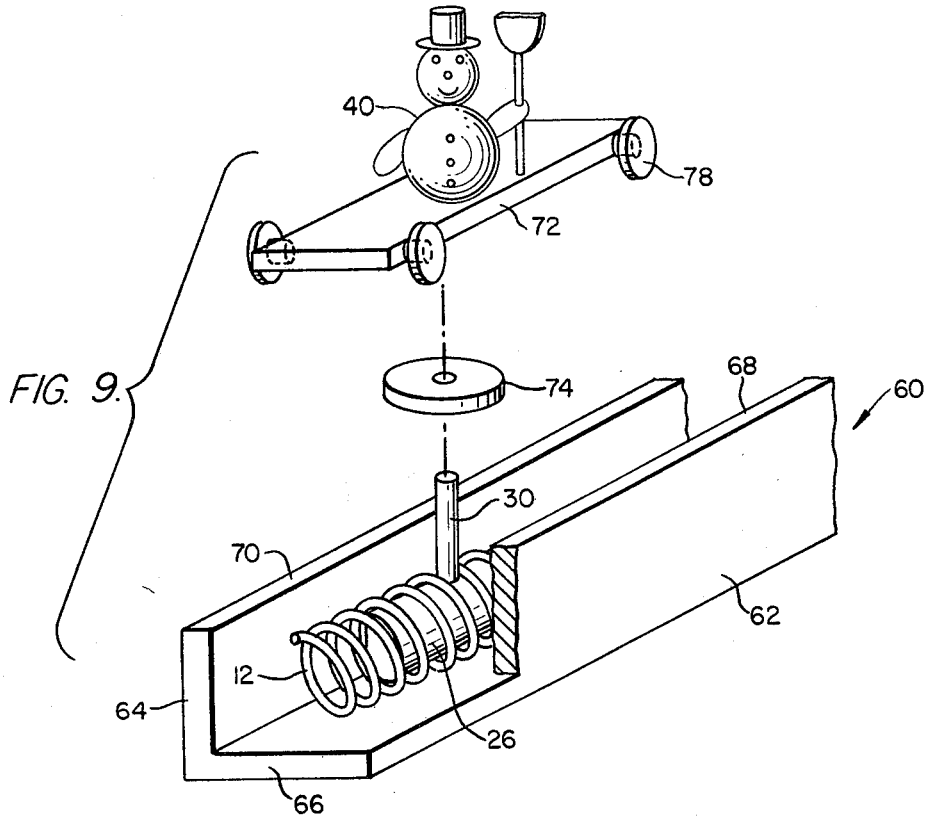
FIG. 9.
FIG. 10.
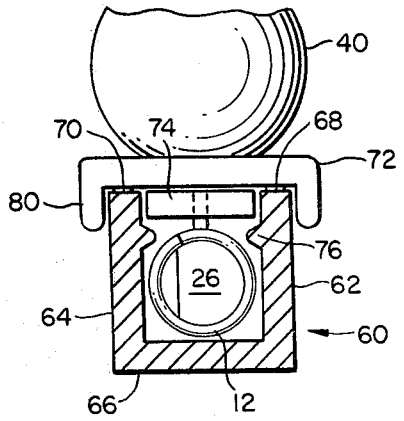

MOTION PRODUCING MECHANISM

This application is a continuation-in-part of U.S. Ser. No. 066,238 filed on Aug. 13, 1979, now U.S. Pat. No. 4,269,122, issued May 26, 1981.

BACKGROUND OF THE INVENTION

The invention relates to a new apparatus for producing motion to drive items such as novelties, displays, or a variety of other items.

In the past, various gears, gear and track combinations, chains, pulley and belt combinations, and pulley and gear combinations in conjunction with friction drives, or a combination of gear and friction drives, have been used to produce forward or backward, circular, eliptical, or wave-like motion. However, in such motion producing mechanisms using such drives, or combinations of such drives, the result is typically a relatively heavy, complicated, and expensive driving mechanism. For example, chains and racks are typically somewhat bulky. Similary, endless belt systems generally require pulleys to stretch the belt across. Such pulleys take up extra space, as well as adding to the weight and cost of the system.

These factors are especially disadvantageous in the use of such motion producing mechanisms to drive novelty items or items for display since such items require the weight and cost of the drive mechanism to be as small as possible. Thus, what is needed, is a motion producing mechanism engineered to be of a very simple, light and inexpensive construction.

SUMMARY OF THE INVENTION

An important object of the present invention is to provide an inexpensive and simple means of producing a desired motion to a driven item.

Another object of the invention is to provide a motion producing mechanism which is of a lightweight construction.

Yet another object of the invention is to provide a motion producing mechanism to drive a novelty or display item either in a forward or backward direction along an eliptical or a circular path, in a wave-like motion clockwise or counterclockwise, or in a sideways or an up and down motion.

To accomplish these and other objects, the present invention provides an apparatus for moving an item along a predetermined path having a hollow holding means, such as a tube or a channel-shaped member, with a slot which extends along the predetermined path. A helically threaded means is provided inside the holding means with a predetermined spacing between each of the threads. Driving means mesh with the space between the threads to move the helically threaded means relative to the hollow holding means. Mounting means, such as pins, are provided on the helically threaded means to extend through the opening in the holding means for connection of an item to the helically threaded means. As an alternative to the helically threaded means, a cable having alternating large and small diameter regions can be provided.

BRIEF DESCRIPTION OF THE DRAWINGS

The above objects and advantages of the present invention will become apparent from the following description taken in connection with the accompanying drawings, wherein

FIGS. 9 and 10 show another alternative embodiment of the present invention.

DESCRIPTION OF THE PREFERRED EMBODIMENTS

Figure 1:
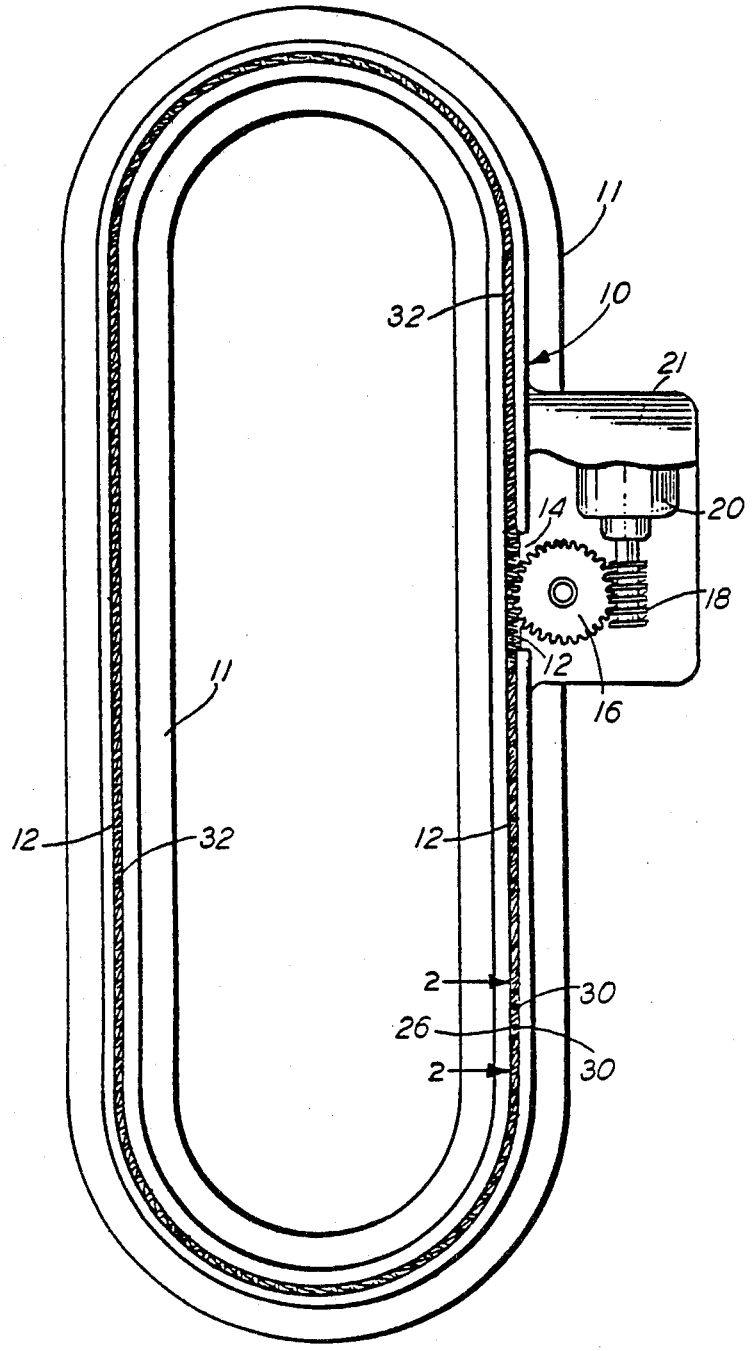
FIG. 1 shows an overall view of a motion producing apparatus according to the present invention.

Referring now to the drawings in detail, wherein like reference characters designate like parts throughout the various views, there is shown in FIG. 1 the completely assembled drive producing mechanism of the present invention.

Referring now to FIG. 1, a hollow tube 10 which forms a generally eliptical path is shown having an internal coil spring 12 extending along the entire eliptical path. The tube 10 is supported by a base 11 which can be made of any convenient material and to which the tube 10 is fastened by any appropriate conventional means. Normally, the base 11 would include a groove in which the tube 10 rests. For example, if $\frac{3}{8}$ inch tubing is used for the tube 10, a $\frac{3}{8}$ inch wide groove $\frac{1}{8}$ inch deep would be suitable.

A predetermined spacing is provided between each of the coils of the spring 12. An opening 14 is provided in the side of the tube 10 to allow a worm gear 16 to extend into the tube 10 to mesh with the coil spring 12. The pinion gear 16 is also coupled to a worm 18 mounted on a shaft of a drive motor 20. As shown in FIG. 1, the base 11 provides a support for the motor and gear assembly, which can be enclosed with a cover 21 if desired.

When the drive motor 20 is activated, it rotates the worm 18. The worm 18 has teeth of a size to match the teeth of the pinion gear 16, so that rotation of the worm 18 causes a corresponding rotation of the pinion gear 16. Similarly, the spacing between the coils of the coil spring 12 is chosen to correspond to the spacing of the teeth of the pinion gear 16 so that rotation of the worm gear 16 causes a linear movement of the coil spring 12 through the tube 10. Of course, the size of the motor 20, the worm 18, the pinion gear 16 and the coil spring 12 are determined by the thrust and speed necessary for the particular operation involved.

Figure 2:
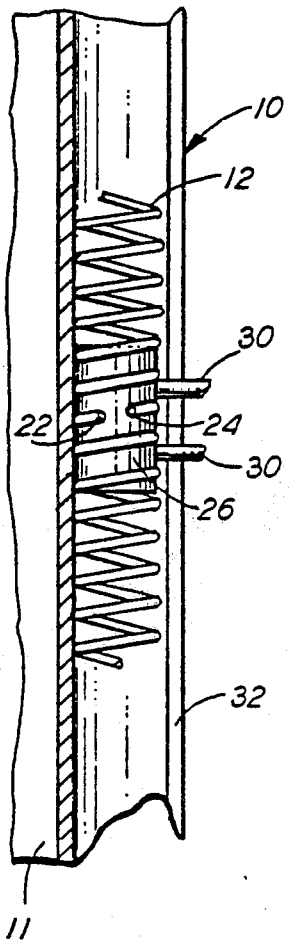
FIG. 2 shows a side view, partially in section, of the spring coupler mounted in the tube of FIG. 1, taken along section 2—2 of FIG. 1.
Figure 3:
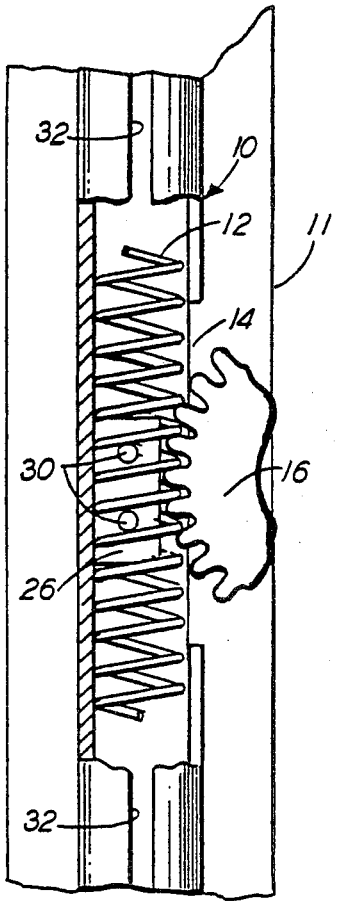
FIG. 3 shows a top view of the coupler mounted in the tube.
Figure 4:
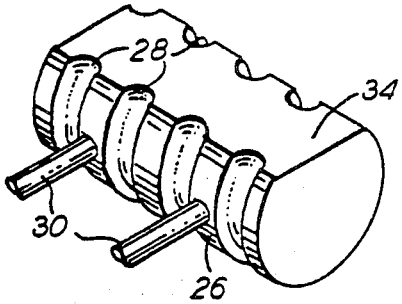
FIG. 4 shows a perspective view of the spring coupler of FIG. 1.

The respective ends 22 and 24 of the coil spring 12 are coupled together by a spring coupler 26 (see FIGS. 2 to 4). This spring coupler 26 is provided with grooves 28 having a depth and spacing corresponding to the coil spring spacing and the diameter of the spring material of the coil spring 20. Thus, the respective ends 22 and 24 of the coil spring 12 can be threaded into the grooves 28 of the spring coupler 26 to form the coil spring 12 into a closed path. Accordingly, when the drive motor 20 drives the coil spring 12, as described above, the spring 12 moves along this closed path inside the tube 10. Although the path shown in FIG. 2 is eliptical, it is, of course, understood that other suitable closed loop shapes such as a circular path, or a snake-like path could be used.

The spring coupler 26 includes a pair of pins 30 which extend through the spacing between coils of the coil spring 12 and through a slot 32 of the tube 10. These pins 30 serve to keep the spring coupler 26 aligned relative to the coil spring 12 and the tube 10, as well as allowing connection of a novelty item to the coupler 26. The slot 32 prevents the coupler 26 from turning inside the tube 10.

Referring now to FIGS. 3 and 4, a flat portion 34 is provided on the spring coupler 26 to allow for clearance of the gear teeth 36 of the pinion gear 16 when the spring coupler moves past the worm gear.

Figure 5:
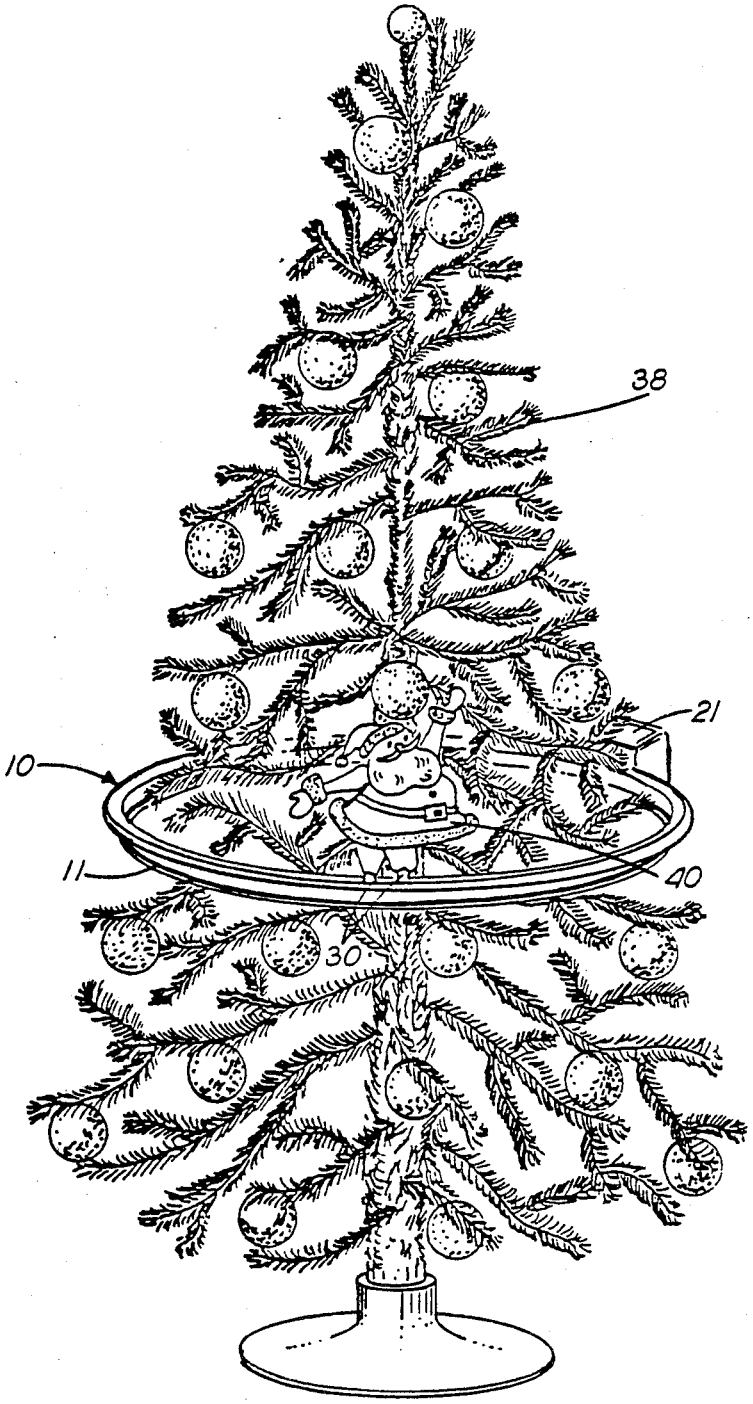
FIG. 5 shows an application of the invention with a novelty item.

FIG. 5 shows the use of the invention in conjunction with a novelty device. More specifically, the tube 10 made of a light plastic material is wound around a Christmas tree 38. A novelty item, such as a Santa Claus figure 40, is attached to the pins 30 of the spring coupler 26. The base 11, which in this case would preferably be made of a light material such as styrofoam, is attached to the tube 10 to assist in retaining the desired shape of the path around the tree as well as for attachment to the tree 38 by hoops or other appropriate means. Also, this base 11 provides a mount for the drive motor 20 and the associated worm 18 and worm gear 16. Typically, for a Christmas tree the base 11 should hold the tube 10 to form a circle having, for example, approximately a two-foot diameter.

In operation, when the motor 20 is activated, the Santa Claus figure 40 will be moved along the path defined by the tube 10 around the tree 38. Of course, additional spring couplers 28 could be threaded into the coil spring 12 to allow for connection of more than one figure along the path of the tube 10. It should be noted in this regard that a spring coupler 26 does not necessarily have to join ends 22 and 24 of the spring 12, but can also be threaded into the middle portion of the spring thus actually acting more as a spring riding means than a spring coupler.

As an example of actual elements to use for a lightweight arrangement such as shown in FIG. 5, a coil spring 12 could be of any convenient material such as steel with 0.025 inches spring wire having 10 coils per linear inch, an outside diameter of 0.250 inches, and an inside diameter of 0.225 inches. Correspondingly, the gear teeth on the pinion gear 16 would be set at 10 teeth per inch. The spring coupler 26 can be made of a lightweight material such as teflon machined to have grooves 28 at a depth approximately 0.010 inch greater than the diameter of the spring wire (in this case the grooves would be 0.035 inches). The outside diameter of the spring coupler 26 is typically set at about 0.010 inches less than the outside diameter of the spring 12 (in this case approximately 0.240 inches). Similarly, the slot 32 of the tube 10 is 0.015 to 0.020 inches wider than the diameter of the pins 30 (which diameter is chosen to match holes in the figure being mounted) to allow for freedom of movement of the enclosed spring 12.

Figure 6:
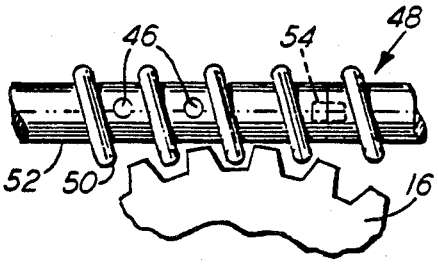
FIGS. 6, 7 and 8 are alternative embodiments of the cable used in conjunction with the present invention.

Although for many applications the light weight of a coil spring is most desirable, there are certain applications where a heavier construction is ueful. In such cases, the alternative embodiments shown in FIGS. 6, 7 and 8 may be used. Specifically, FIG. 6 shows a solid helically threaded cable 44 used in place of the coil spring 12. This cable 44 can be made of any convenient metal or plastic material, and may be rigid or flexible depending on the application intended. Pins 46 are provided on the cable 44 to extend through the slot 32 in the tube 10 for connection of an item to be moved.

Figure 7:
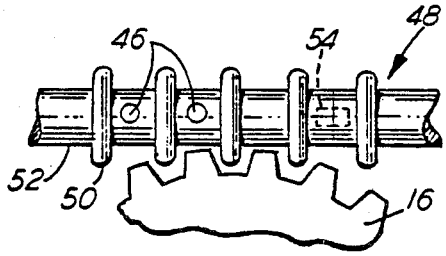
Figure 8:
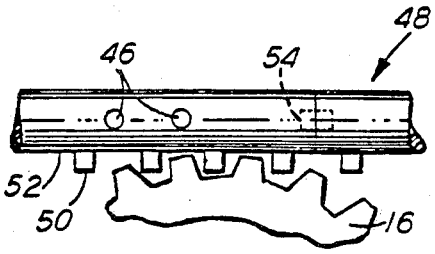

FIGS. 7 and 8 show an alternative to FIG. 6 wherein a cable 48 having alternating large and small diameter regions 50 and 52, respectively, is used instead of a helically threaded cable. In FIG. 7, the large diameter regions extend out from the small diameter regions on both sides, while in FIG. 8, the large diameter region extends from the small diameter region only along the side which will contact the gear 16.

In FIGS. 6, 7 and 8, the ends of the cables 44 and 48 can be joined together by means of a small pin 54. The ends of the cables should be matched as to diameter so that the alternating large and small diameter pattern continues without interruption over the connected ends.

FIGS. 9 and 10 illustrate a further embodiment of the present invention which is specifically designed to reduce the weight which is placed on the spring or cable by the item. In particular, in FIGS. 9 and 10, a substantially channel-shaped spring holder 60 is provided in place of the tube 10 described earlier. This channel-shaped spring holder 60 has a pair of substantially parallel upward extending sides 62 and 64 and a lower portion 66 which joins the sides 62 and 64 together. As shown in FIGS. 9 and 10, the spring rides along the lower portion 66 of the channel-shaped spring holder. A spring coupler 26 rides along with the spring to move the item 40 in the same manner as discussed above with regard to FIGS. 1 through 4. Alternatively, cables such as shown in FIGS. 6 through 8 could be used.

An important aspect of the embodiment of FIGS. 9 and 10 can be seen from a careful study of FIG. 10. As shown there, the top surfaces 68 and 70 of the upward extending portions 62 and 64 are substantially flat. Thus, these top surfaces 68 and 70 can provide a stable track for a carrier 72 upon which the item 40 can be mounted. In this manner, the primary weight of the item 40 will be placed on the top surfaces 68 and 70 of the channel-shaped spring holder 60 rather than on the coil spring 12 (or the cable if utilizing the embodiments of FIGS. 6 through 8).

In order to ensure that the pin 30 of the spring coupler 26 remains in its proper position, a centering idler 74 can be placed over the pin 30 between the inward facing sides of the parallel upward extending sides 62 and 64. As shown in FIG. 10, the pin 30 will extend through this centering idler 74 into a hole in the bottom of the carrier 72. In addition, protrusion 76 can be provided on interfacing walls of the upward extending sides 62 and 64 to prevent the spring from falling out if the channel-shaped spring holder is turned over.

With regard to the carrier 72 itself, it can be stabilized along the track by providing either flanged wheels 78 extending out over the outward facing walls of the upward extending sides 62 and 64 (as shown in FIG. 9) or by simple extending portions 80 of the carrier which extend over the outward facing walls of the sides 62 and 64 (as shown in FIG. 10). Of course, although the carrier is shown as a separate element from the item 40, it could be integrally molded as the base of the item 40 if desired.

Therefore, FIGS. 9 and 10 provide an alternative embodiment which permits a significant reduction of the weight on the spring 12. This lessens the driving forces necessary to move the spring and reduces the noise of the operation. Also, one only needs a single pin 30 because there is no longer a need for a plurality of pins to center the item to prevent is turning sideways during travel.

Although the tube 10 and the channel-shaped spring holder 60 would be made of flexible plastic materials, it is, of course, to be understood that they could be made of other materials, including rigid ones such as steel tubing. It is also understood that these elements could have cross-sectional shapes different than those shown. Similarly, the slot 32 could be located elsewhere along the top of the tube 10. Thus, it could be along the bottom or sides at any location convenient for the particular use intended.

Also, although the spring 12 has been described as being made of metal, it is to be understood that it could also be made of a suitable plastic material. The spring 12 is coil wound to have a set number of coils to the inch, which matches the spacing of the teeth of the pinion gear 16.

The speed of the pinion gear 16 is controlled by a chain of gears driven by an electric motor. It is, of course, understood that the gear could be driven by a spring mechanism, a weighted mechanism or by said electric motor. Also, the drive can be arranged to move a figure back and forth along the path rather than in one direction. Similarly, the invention can be used with an open ended track rather than a closed loop, if desired. Further, the pinion gear 16 could be replaced by a rubber wheel having an outer surface which is flexible enough to mesh with the coil spring or cable by being depressed in areas which contact the raised portions of the spring or cable.

Further, although this invention has been described in terms of a spring or cable drive, which does provide many advantages as discussed above, it should be understood that the present invention could also be applied to moving an element which is self-powered (e.g. by a battery operated motor) around a tree for display purposes. This is especially the case when a channel-shaped spring holder 60 such as shown in FIGS. 9 and 10 is used. In such a case, because of the sturdy support for the item provided by the channel-shaped spring holder 60, a self-powered carrier could be moved along the top surfaces of the channel-shaped spring holder around a tree.

In using a channel-shaped spring holder 60, a styrofoam base 11 such as shown in FIG. 5 could be used to support the holder 60 on the branches. Alternatively, the lightweight holder 60 could itself be directly attached to the branches of the tree by hooks or other approriate clips so that the top surfaces 68 and 70 face upward to support the carrier. It is important to note that such an arrangement is possible because of the light weight of the holder 60. In fact, in dealing with many Christmas trees, the strength of the branches is sufficient to support the holder 60 with little or no clipping. The holder 60 can simply rest on the branches. Of course, if a self-powered item or carrier is used, this would mean that considerably more weight would be included in either the carrier or the item because of the necessity of its holding the motor and the battery. And this would, of course, increase the amount of friction and noise generated. However, in some situations, such drawbacks could be tolerated if weight and noise were within the limits of desired operation.

The above-described motion producing mechanisms, because of their simplicity and lightweight construction are ideally suited for driving lightweight novelties or displays. It is to be understood, however, that it could be designed to be of a sturdier nature to drive heavier or large novelties or displays. It could also be used to drive a unit or item added to an existing machine or tool or to drive the item or unit itself. To this end, the abovedescribed mechanisms could be used as a conveyor to transport items either along a closed or open path.

Although I have herein shown and described the invention in what I belive to be the most practical and preferred embodiments, it is recognized that depature may be made therefrom within the scope of my invention, which is not to be limited to the details disclosed herein, but is to be accorded the full scope of the claims so as to embrace any and all equivalent structures and devices.

I claim:

1. An apparatus for moving an item along a predetermined path, comprising:

hollow holding means extending along said predetermined path, said holding means including an opening which also extends along said predetermined path;

helically threaded means provided inside said hollow holding means, said helically threaded means having a predetermined spacing between each of its threads;

drive means for meshing with the spacing between each of the threads of said helically threaded means to move said helically threaded means relative to said hollow holding means along said predetermined path;

mounting means coupled to said helically threaded means including means extending through the opening in said hollow holding means for mounting said item on said helically threaded means; and a carrier mounted on said mounting means for supporting said item, wherein the hollow holding means includes two substantially parallel upward extending portions on each side of the opening, and wherein each of said upward extending portions has a top surface which is substantially flat so that the bottom of said carrier will be supported by said flat top surfaces with the majority of the weight of the carrier and the item attached to said carrier being supported by said top surfaces.

2. An apparatus according to claim 1, wherein said two substantially parallel upward extending portions of said hollow holding means are freestanding.

3. An apparatus for moving an item along a predetermined closed path, comprising:

hollow holding means extending along said predetermined closed path;

helically threaded means provided inside said hollow holding means, said helically threaded means having a predetermined spacing between each of its threads;

drive means for meshing with the spacing between the threads of said helically threaded means to move said helically threaded means relative to said hollow holding means along said predetermined closed path;

mounting means coupled to said helically threaded means including means for mounting said item on said helically threaded means; and a carrier mounted on said mounting means for supporting said item, wherein the hollow holding means includes two substantially parallel upward extending portions on each side of the opening, and wherein each of said upward extending portions has a top surface which is substantially flat so that the bottom of said carrier will be supported by said flat top surfaces with the majority of the weight of the carrier and the item attached to said carrier being supported by said top surfaces.

4. An apparatus according to claim 3, wherein said two substantially parallel upward extending portions of said hollow holding means are freestanding.

5. An apparatus according to claim 1 or 3, wherein said holding means has a substantially U-shaped cross-section with a lower portion joining said parallel upward extending portions.

6. An apparatus according to claim 5, wherein said helically threaded means rests on said lower portion.

7. An apparatus according to claim 6, wherein an internal surface of at least one of said upward extending portions includes a protrusion toward the internal surface of said other upward extending portion to prevent movement of the helically threaded means out of the holding means.

8. An apparatus according to claim 1 or 3, including a centering idler which is located on said mounting means between the helically threaded means and the carrier means, said centering idler extending between said pair of parallel upward extending portions to restrain sideways movement of the carrier relative to the holding means.

9. An apparatus according to claim 1 or 3, wherein said carrier includes means extending over external side surfaces of each of said upward extending portions to restrict movement of said carrier relative to said holding means.

10. An apparatus according to claim 9, wherein said extending means comprise flanged wheels.

11. An apparatus for moving an item along a predetermined path comprising:

hollow holding means extending along said predetermined path, said holding means including an opening which also extends along said predetermined path;

a cable provided inside said hollow holding means, said cable having alternating areas of first and second diameters, wherein said first diameter is larger than said second diameter, and wherein a predetermined spacing exists between adjacent areas of the first diameter;

drive means for meshing with the spacing between adjacent areas of the first diameter to move said cable relative to said hollow holding means along said predetermined path;

mounting means coupled to said cable including means extending through the opening in said hollow holding means for mounting said item on said cable; and a carrier mounted on said mounting means for supporting said item, wherein the hollow holding means includes two substantially parallel upward extending potions on each side of the opening, and wherein each of said upward extending portions has a top surface which is substantially flat so that the bottom of said carrier will be supported by said flat top surfaces with the majority of the weight of the carrier and the item attached to said carrier being supported by said top surfaces.

12. An apparatus according to claim 11, wherein said two substantially parallel upward extending portions of said hollow holding means are freestanding.

13. An apparatus for moving an item along a predetermined closed path, comprising:

hollow holding means extending along said predetermined closed path;

a cable mounted inside said hollow holding means, said cable having alternating areas of first and second diameters, wherein said first diameter is larger than said second diameter, and wherein a predetermined spacing exists between adjacent areas of the first diameter;

drive means for meshing with the spacing between adjacent areas of the first diameter to move said cable relative to said hollow holding means along the predetermined closed path;

means coupled to said cable for mounting said item on said cable; and a carrier mounted on said mounting means for supporting said item, wherein the hollow holding means includes two substantially parallel upward extending portions on each side of the opening, and wherein each of said upward extending portions has a top surface which is substantially flat so that the bottom of said carrier will be supported by said flat top surfaces with the majority of the weight of the carrier and the item attached to said carrier being supported by said top surfaces.

14. An apparatus according to claim 13, wherein said two substantially parallel upward extending portions of said hollow holding means are freestanding.

15. An apparatus according to claim 11 or 13, wherein said holding means has a substantially U-shaped cross-section with a lower portion joining said parallel upward extending portions.

16. An apparatus according to claim 15, wherein said cable rests on said lower portion.

17. An apparatus according to claim 16, wherein an internal surface of at least one of said upward extending portions includes a protrusion toward the internal surface of said other upward extending portion to prevent movement of said cable out of the holding means.

18. An apparatus according to claim 11 or 13, including a centering idler which is located on said mounting means between the helically threaded means and the carrier means, said centering idler extending between said pair of parallel upward extending portions to restrain sideways movement of the carrier relative to the holding means.

19. An apparatus according to claim 11 or 13, wherein said carrier includes means extending over external side surfaces of each of said upward extending portions to restrict movement of said carrier surface to said holding means.

20. An apparatus according to claim 19, wherein said extending means comprise flanged wheels.

21. An apparatus for moving an item along a predetermined path comprising:

a hollow tube forming a closed loop extending along said predetermined path, said hollow tube including an opening which also extends along said predetermined path;

a cable forming a closed loop provided inside said hollow tube, said cable having alternating areas of first and second diameters, wherein said first diameter is larger than said second diameter, and wherein said cable is formed as a solid unitary structure with said first areas being integrally formed with said second areas so that said first areas remain in the same relative position to one another along said cable such that a predetermined spacing is continuously maintained between adjacent areas of the first diameter;

drive means for meshing with the spacing between adjacent areas of the first diameter to move said cable relative to said hollow tube along said predetermined path; and mounting means coupled to said cble including means extending through the opening in said hollow tube for mounting said item on said cable.

22. An apparatus for moving an item along a predetermined closed path, comprising:

a hollow tube forming a closed loop extending along said predetermined closed path;

a cable forming a closed loop mounted inside said hollow tube, said cable having alternating areas of first and second diameters, wherein said first diameter is larger than said second diameter, and wherein said cable is formed as a solid unitary structure with said first areas being integrally formed with said second areas so that said first areas remain in the same relative position to one another along said cable such that a predetermined spacing is continuously maintained between adjacent areas of the first diameter;

drive means for meshing with the spacing between adjacent areas of the first diameter to move said cable relative to said hollow means along the predetermined closed path; and means coupled to said cable for mounting said item on said cable.

* * * * *